US009187838B2

(12) United States Patent
Levey

(10) Patent No.: US 9,187,838 B2
(45) Date of Patent: Nov. 17, 2015

(54) THIN-TIN TINPLATE

(71) Applicant: Rohm and Haas Electronic Materials LLC, Marlborough, MA (US)

(72) Inventor: Peter R. Levey, Northborough, MA (US)

(73) Assignee: Rohm and Haas Electronic Materials LLC

( * ) Notice: Subject to any disclaimer, the term of this patent is extended or adjusted under 35 U.S.C. 154(b) by 0 days.

(21) Appl. No.: 14/058,648

(22) Filed: Oct. 21, 2013

(65) Prior Publication Data

US 2014/0110266 A1 Apr. 24, 2014

Related U.S. Application Data

(60) Provisional application No. 61/716,450, filed on Oct. 19, 2012.

(51) Int. Cl.

| | |
|---|---|
| ***C25D 5/36*** | (2006.01) |
| ***C25D 5/34*** | (2006.01) |
| ***C25D 3/30*** | (2006.01) |
| ***C25D 5/50*** | (2006.01) |

(52) U.S. Cl.
CPC .. *C25D 5/36* (2013.01); *C25D 3/30* (2013.01); *C25D 5/505* (2013.01)

(58) Field of Classification Search
CPC ..... C25D 5/18; C25D 5/36
USPC ..... 205/217, 219
See application file for complete search history.

(56) References Cited

U.S. PATENT DOCUMENTS

| | | | | |
|---|---|---|---|---|
| 1,776,603 | A | 9/1930 | Schulte | |
| 2,973,307 | A | 2/1961 | Hahn | |
| 4,113,580 | A * | 9/1978 | Tsutsui et al. | 205/176 |
| 4,324,621 | A | 4/1982 | Kerby | |
| 4,388,158 | A * | 6/1983 | Inui et al. | 205/154 |
| 4,764,260 | A | 8/1988 | Gay et al. | |
| 5,174,887 | A | 12/1992 | Federman et al. | |
| 5,223,087 | A | 6/1993 | Itani et al. | |
| 5,268,081 | A | 12/1993 | Dousek | |
| 5,433,839 | A * | 7/1995 | Amelot | C25D 5/505 205/154 |
| 5,445,945 | A | 8/1995 | Drechsler | |
| 5,498,300 | A | 3/1996 | Aoki et al. | |
| 5,628,893 | A | 5/1997 | Opaskar | |
| 5,759,651 | A | 6/1998 | Machii et al. | |
| 6,174,426 | B1 | 1/2001 | Osanaiye | |
| 6,749,952 | B2 | 6/2004 | Shigekuni et al. | |
| 6,860,981 | B2 | 3/2005 | Schetty, III et al. | |
| 6,923,899 | B2 | 8/2005 | Brown et al. | |
| 7,001,494 | B2 | 2/2006 | Jovic et al. | |
| 7,151,049 | B2 | 12/2006 | Beica et al. | |
| 7,465,384 | B2 | 12/2008 | Levey et al. | |
| 7,938,950 | B2 | 5/2011 | Kurokawa et al. | |
| 7,968,444 | B2 | 6/2011 | Luo et al. | |
| 8,172,990 | B2 | 5/2012 | McAlister | |
| 2003/0226758 | A1 * | 12/2003 | Egli | 205/252 |
| 2006/0272950 | A1 * | 12/2006 | Martyak et al. | 205/261 |

FOREIGN PATENT DOCUMENTS

| | | | | |
|---|---|---|---|---|
| EP | 0080971 A1 | 1/1982 | | |
| GB | 1027495 | 5/1962 | | |
| JP | 50008734 A * | 1/1975 | | C25D 11/38 |
| JP | 54117332 | 9/1979 | | |
| JP | 57185997 | 11/1982 | | |

OTHER PUBLICATIONS

Mannheim, "Interaction Between Metal Cans and Food Products", Food Product—Package Compatibility Proceedings (© 1987), 6 pp. http://books.google.com/books?hl=en&lr=&id=xqhCHespUwUC& oi=fnd&pg=PA105&dq=FeSn2+C+Mannheim&ots=2eigZjNXwM&sig=LQJaMu-BVjqhdJEbN_cZ5qofkBw#y=onepage&q&f=false.*

* cited by examiner

*Primary Examiner* — Edna Wong
(74) *Attorney, Agent, or Firm* — John J. Piskorski

(57) ABSTRACT

Iron containing substrates are electrically polarized in a pre-plating composition which activates the surface of the steel substrate to receive thin tin or tin alloy. The thin tin or tin alloy is electroplated onto the activate surface of the steel substrate. The thin tinplate and alloy have reduced amounts of pores in the surface.

10 Claims, No Drawings

THIN-TIN TINPLATE

FIELD OF THE INVENTION

This application claims the benefit of priority under 35 U.S.C. §119(e) to U.S. Provisional Application No. 61/716,450, filed Oct. 19, 2012, the entire contents of which application are incorporated herein by reference.

The present invention is directed to a method of electroplating thin-tin tinplate. More specifically, the present invention is directed to a method of electroplating thin-tin tinplate to reduce the porosity of the thin-tin tinplate.

BACKGROUND OF THE INVENTION

Tinplate has been successfully used for packaging foodstuffs by virtue of a fortuitous redox-potential reversal. Under normal oxygenated conditions, a steel substrate is anodic to the tin coating and any porosity of the tin coating exposes the steel to the unfortunate predicament of being a small anode-connected-to-a-big-cathode, leading to rapid red-rusting under atmospheric exposure, or pinhole perforation when exposed as a foodstuff package, i.e. a tin can. However, assuming an initial pore-free tin coating, the oxygen in a newly enclosed tin can (oxygen would be found in the head-space and be dissolved in the foodstuff) would be consumed by corrosion of the exposed free-tin during the stoving process in which the food can is heated, cooking the contents. This etching of the free-tin may expose the electrolytically inert $FeSn_2$ intermetallic layer, an interfacial layer formed by reaction of the molten tin with the steel substrate during the reflow-melting process used in tinplate manufacture, or expose the steel substrate, if the $FeSn_2$ intermetallic layer is porous, leading to can failure. Assuming no porosity of an exposed intermetallic layer, the free-tin corrosion continues until the can is fully de-oxygenated, at which point the electrochemical couple between tin and steel reverse: the steel substrate is now cathodic. Any steel then exposed by slow dissolution of the tin coating is cathodically protected by corrosion of the surrounding free-tin, resulting in a can life determined by the amount of available free tin (i.e. that not bound in the inert $FeSn_2$ intermetallic layer).

The overall suitability and quality of tinplate for food packaging is thus determined by:

- The gross porosity of the tin coating; the steel substrate should not be exposed during stoving, thereby forestalling rapid initial can failure.
- The impermeability of the $FeSn_2$ intermetallic layer. This layer should be dense and pore-free.
- The amount of free tin higher amounts both allow for greater oxygen-removal during stoving and also permit long shelf-lives under deoxygenated conditions.

Porosity is the principle factor in determining tinplate corrosion resistance, both bulk porosity and porosity of the $FeSn_2$ intermetallic layer. Porosity of tinplate is commonly due to either sub-optimal tin electrodeposition, poor blackplate (the unplated steel substrate) activation (cleaning and pickling) and also gross surface inhomogeneities such as carbon residues, oils, oxide or other steel substrate inclusions.

There are different grades of tinplate, normally differentiated by their tin coating-weight, with lighter weights<2.8 $g/m^2$ being used in an epoxy-lacquered state and thicker coatings>5.6 $g/m^2$ being used in applications requiring superior corrosion resistance such as white-fruits such as pineapple, asparagus, or sulfide-stain resistant meats. For corrosion resistance, the impermeability of the intermetallic layer plays a role and tinplate manufacturers aim for impermeability by producing thicker intermetallic layers. As the $FeSn_2$ intermetallic layer is formed by consumption of the free tin, a thick $FeSn_2$ intermetallic layer typically requires a high initial tin coating weight and an extended reflow-melting time.

With the rising price of tin metal, tin packaging has been shifting to lighter coating weights in an effort to reduce cost, but have hit a technological barrier in that electrolytically produced tinplate for food packaging is traditionally considered to be porous at coating weights below 2.8 $g/m^2$. Certain foodstuffs rely on the dissolved tin for further preservation of color, texture and flavor and cannot easily switch to a lacquered can. There thus exists a need for thin-tin and thin-tin alloy tinplate that has corrosion resistance equal to that of higher coating weight material.

SUMMARY OF THE INVENTION

Methods include: providing a steel substrate; contacting the steel substrate with a pre-plating composition including one or more organic sulfonic acid compounds, salts or anhydrides thereof, and one or more grain refiners; electrolytically polarizing the steel substrate; and electrolytically plating tin on the steel substrate.

The methods provide a more homogeneous substrate surface which is substantially free of carbon residues, oils, $Fe(OH)_2$, oxides and other steel substrate inclusions, such as low sulfur and silicon which cannot be plated over. The pre-plating composition coats the steel surface prior to tin or tin alloy plating and ensures a high surface-additive concentration which is not dependent on the additive concentrations in the tin or tin alloy plating bath. The methods also provide finer tin and tin alloy grain size and reduced tin or tin alloy and porosity of $FeSn_2$ intermetallic layers, thus inhibiting oxygen penetration of the tin or tin alloy and $FeSn_2$ intermetallic layers and reducing corrosion of the underlying steel substrate. The $FeSn_2$ intermetallic layer is thinner and denser than conventional $FeSn_2$ intermetallic layers, thus less tin or tin alloy is consumed by the intermetallic layer and more free tin or tin alloy is provided, thus the life of the steel substrate is increased.

DETAILED DESCRIPTION OF THE INVENTION

As used throughout this specification, the following abbreviations shall have the following meanings, unless the context clearly indicates otherwise: ° C.=degrees Centigrade; g=gram; kg=kilogram; L=liter; cm=centimeter; dm=decimeter, nm=nanometers; RPM=revolutions per minute; A=amps; ASD=$A/dm^2$; mol=mole; DI=deionized water; and wt %=percent by weight. The terms "depositing", "electroplating" and "plating" are used interchangeably throughout this specification. All percentages are by weight, unless otherwise noted. All numerical ranges are inclusive and combinable in any order, except where it is logical that such numerical ranges are constrained to add up to 100%.

Although the method is described using a steel substrate, it is envisioned that many iron containing substrates may be tinplated or tin alloy plated. Preferably, the steel is low carbon steel. Low carbon steel contains from 0.02% to 0.3% carbon.

Typically the steel substrate is first cleaned of oils. The cleaning may be done chemically or electrolytically using conventional methods known in the art. The steel may be cleaned chemically by being placed in contact with a solution based on alkaline mixtures containing sodium hydroxide, sodium carbonate, sodium metasilicate, phosphates, complexing agents and surfactants. The alkaline component may be from 3 wt % to 12 wt %. The alkaline solutions typically range in temperature from 50° C. to 85° C. Preferably the alkaline compound is sodium hydroxide. Cleaning may also include conventional cleaning processes such as brush agitation, application of electric current to generate hydrogen or oxygen gas on the steel substrate. Cleaning solutions may also utilize defoaming agents, additional chelating and saponification agents to assist in the suspension of the removed dirt and organic soils.

The cleaning may also be done electrolytically in an electrolysis bath containing an aqueous alkaline solution of calcium carbonate or potassium hydroxide or mixtures thereof. The bath may include the alkaline compounds in amounts of 0.5-20 wt %. The temperature of the bath may range from 20-95° C. The steel may then be subjected to current densities of 0.1-20 A/dm$^2$ for a period longer than 0.1 second, typically from 0.1 second to 10 seconds. The current may be either grid-to-grid in which the steel strip is exposed to first anodic then cathodic or held at a cathodic potential. Such methods are conventional and well know in the art.

After the steel substrate is cleaned it is then rinsed with water and pickled. The pickling may be done chemically or electrolytically using conventional methods. The steel may be pickled chemically by being immersed in a bath containing an inorganic acid such as sulfuric acid, hydrochloric acid or other inorganic acid. The acids are typically included in amounts of 0.2-50 wt %. The steel is kept in the pickling bath for at least 0.1 second, typically from 0.1 second to 10 seconds. The temperature of the pickling bath may range from 20-60° C.

When the steel is pickled electrolytically, it is immersed in an inorganic acid bath containing sulfuric acid, hydrochloric acid or other inorganic acid. The acid is included in amounts of 0.2-20 wt %. The temperature of the bath may range from 20-75° C. The current density may be 0.1-50 A/dm$^2$. Pickling is done for greater than 0.1 second, typically from 0.1 second to 10 seconds.

After the steel is pickled it is rinsed with water and then immersed into a pre-plating composition containing at least one or more organic sulfonic acid compounds and one or more grain refiners. The pre-plating composition completes the activation of the substrate, removes any ferrous-hydroxide species formed during the rinse after pickle and coats the surface of the steel with surface-active electroplating grain refiners to ensure a high surface concentration that is beneficial during the initial stages of tin electroplating. The initial high concentrations of the pre-plating composition components on the substrate promote the formation of fine-grained low porosity tin electrodeposits when the strip is exposed to cathodic current in the subsequent electrodeposition step. Grain sizes may range from 5-200 nm, preferably from 5-150 nm, more preferably from 5-50 nm. Fine grained tin deposits also produce a thinner and denser $FeSn_2$ intermetallic layer during the subsequent reflow melting operation, thus providing for more free tin as the growth of a dense $FeSn_2$ alloy layer tends to slow down with less exposure of the molten tin to the steel substrate. $FeSn_2$ intermetallic layers may range from 0.1-1.4 g/m$^2$, preferably from 0.2-1 g/m$^2$, more preferably from 0.3-0.8 g/m$^2$. The high surface concentrations of pre-plate components also reduce steel substrate dependency on the electroplating bath additive concentrations. In conventional electroplating processes the plating additives have to compete with the metal species for access to the substrate at the same time that tin is being electrodeposited. In addition plating bath additives are dissolved in the bulk tin plating bath electrolyte and their effects on the steel surface are reduced through dilution with other species. The locally high concentration of surface-active grain refiners and other species beneficial to electroplating makes their bulk concentration in the tin plating bath less critical: the species are concentrated where they are needed. Once the initial strike coating of tin-onto-steel is accomplished, successive deposition of tin-onto-tin or tin alloy-onto-tin alloy, i.e., growth of the layer thickness is less critically dependent on the electroplating additives.

The one or more organic sulfonic acids in the pre-plate composition include, but are not limited to alkane sulfonic acids, such as methane sulfonic acid, methane disulfonic acid, ethyl sulfonic acid; alkylol sulfonic acids; aromatic sulfonic acids, such as phenol sulfonic acid, 5-sulfosalicylic acid and phenyl sulfonic acid. Salts of such organic acids and anhydrides also may be included in the pre-plating composition. Preferably the organic sulfonic acids are one or more alkane sulfonic acids, salts or anhydrides thereof. Organic sulfonic acids, salts and anhydrides thereof may be included in the pre-plating compositions in amounts of 0.1 g/L to 50 g/L, preferably from 0.25 g/L to 25 g/L, more preferably from 0.5 g/L to 5 g/L.

Optionally, inorganic acids are included in the pre-plate compositions. Such inorganic acids include, but are not limited to sulfuric acid, hydrochloric acid, nitric acid, hydrofluoric acid, sulfamic acid and salts thereof. When inorganic acids are included in the pre-plate composition they are typically included in amounts of 0.1 g/L to 25 g/L, preferably from 0.5 g/L to 10 g/L, more preferably from 1 g/L to 5 g/L.

Grain refiners are included in the pre-plate compositions in amounts of 0.01 g/L to 10 g/L, preferably 0.1 g/L to 5 g/L. Such grain refiners include, but are not limited to carboxy aromatic compounds. A wide variety of such carboxy aromatic compounds are well known to those of skill in the art, such as picolinic acid, nicotinic acid, and isonicotinic acid. Other suitable grain refiners include alkoxylates, such as the polyethoxylated amines sold under the tradenames of JEFFAMINE™ T-403, available from Huntsman Corporation, or TRITON™ RW, or sulfated alkyl ethoxylates, such as those sold under the tradenames TRITON™ QS-15, and gelatin and gelatin derivatives.

Certain surfactants or combinations of surfactants may also operate as grain refiners. Average molecular weights range from 500 to 20,000 g/mole. Examples of non-ionic surfactants include alkylene oxide compounds. Alkylene oxide compounds include, but are not limited to ethylene oxide/propylene oxide ("EO/PO") copolymers, alkylene oxide condensation products of an organic compound having at least one hydroxy group and having up to 20 carbon atoms and compounds prepared by adding oxypropylene to polyoxyethylene glycol. Preferably, the alkylene oxide compound is an EO/PO copolymer. Such alkylene oxide compounds may be present in the pre-plating compositions in amounts of 0.01 g/L to 20 g/L, preferably from 0.1 g/L to 10 g/L, more preferably from 0.2 g/L to 5 g/L. Preferably the average molecular weight is 500 to 12,000 g/mole, more preferably 600 to 5000 g/mole.

Examples of alkylene oxide condensation products of an organic compound having at least one hydroxy group and up to 20 carbon atoms include those having an aliphatic hydrocarbon of from one to seven carbon atoms, an unsubstituted aromatic compound or an alkylated aromatic compound having six carbons or less in the alkyl moiety, such as those disclosed in U.S. Pat. No. 5,174,887 and U.S. Pat. No. 6,322,686. The aliphatic alcohols may be saturated or unsaturated. Examples of aromatic compounds are those having up to two aromatic rings. The aromatic alcohols have up to 20 carbon atoms prior to derivatization with ethylene oxide (EO). The number of moles of EO may range from 5 to 50, preferably from 5 to 40, more preferably from 5 to 30. Such aliphatic and aromatic alcohols may be further substituted, such as with sulfate or sulfonate groups. Such alkylene oxide compounds include, but are not limited to: ethoxylated polystyrenated phenol having 12 moles of EO, ethoxylated butanol having 5 moles of EO, ethoxylated butanol having 16 moles of EO, ethoxylated butanol having 8 moles of EO, ethoxylated octanol having 12 moles of EO, ethoxylated beta-naphthol having 13 moles of EO, ethoxylated bisphenol A having 10 moles of EO, ethoxylated sulfated bisphenol A having 30 moles of EO and ethoxylated bisphenol A having 8 moles of EO.

Other suitable non-ionic surfactants include polyalkylene glycols. Average molecular weights range from 1000 to 20,000 g/mole. Suitable polyalkylene glycols include, but are not limited to, polyethylene glycol, and polypropylene glycol. Such polyalkylene glycols are generally commercially available from a variety of sources and may be used without further purification. In general, such polyalkylene glycols are present in the pre-plate compositions in amounts of 0.1 g/L to 15 g/L, preferably from 0.2 g/L to 10 g/l, more preferably from 0.25 g/l to 5 g/L. When the polyalkylene glycols are polyethylene glycol or polypropylene glycol, they are most preferably included in amounts of 0.1 g/L to 8 g/L.

Optionally, metal solubilizing agents can be included in the pre-plate compositions. Metal solubilizing agents include, but are not limited to chemical chelating or complexing agents. Examples of chelating agent are aminocarboxylic acids such as ethylenediaminetetraacetic acid (EDTA), diethylenetriaminepentaacetic acid (DTPA), triethyleneteraamine hexacetic acid (TTHA), polyphosphates such as sodium tripolyphosphate and hexametaphosphoric acid, hydroxycarboxylic acids such as tartaric acid, glycolic acid and citric acid, polyamines such as ethylenediamine, aminoalcohols such as triethanolamine and diethanolamine, aromatic heterocylcic bases such as dipyridyl and o-phenanthroline, aminophenols such as 8-hydroxyquinoline, sulfur containing compounds such as thioglycolic acid and dithiotartaric acid and phenols. Salts of such chelating agents also may be included. Examples of salts are disodium EDTA and sodium citrate. Chelating or complexing agents are included in the pre-plating composition in amounts of 0.1 g/L to 25 g/L, preferably from 0.2 g/L to 15 g/L, more preferably from 0.5 g/L to 10 g/L.

Optionally, the pre-plating composition may further include one or more additional tin plating promoting agents. Such tin plating promoting agents include, but are not limited to reducing agents and brightening agents. Buffering agents may also be included to maintain a desired pH range. Conventional buffering agents may be used and are included in amounts to achieve the pH range desired. Preferably, the pre-plating composition is free of added metals and metal ions, though metals from the substrate may be present in the pre-plating composition during treatment.

Reducing agents may be added to the pre-plating composition in amounts of 0.1 g/L to 20 g/L, preferably from 0.2 g/L to 10 g/L, more preferably from 0.25 g/L to 8 g/L. Examples of reducing agents are hydroxylated aromatic compounds, such as 1,2,3-trihydroxybenzene, 1,2-dihydroxybenzene, 1,2-dihydroxybenzene-4-sulfonic acid, 1,2-dihydroxybenzene-3,5-disulfonic acid, 1,4-dihydroxybenzene, 1,4-dihydroxybenzene-2-sulfonic acid, 1,4-dihydroxybenzene-2,5-disulfonic acid, 2,4-dihyroxybenzene sulfonic acid, 3,5-dihydroxybenzene sulfonic acid, hydroquinone, resorcinol and catechol.

Examples of brighteners are aromatic aldehydes such as chlorobenzaldehyde, derivatives of aromatic aldehydes such as benzal acetone, and aliphatic aldehydes such as acetaldehyde and glutaraldehyde. Brighteners are included in the pre-plating composition in amounts of 0.5 g/L to 3 g/L, preferably from 1 g/L to 3 g/L.

The pH of the pre-plating compositions may range from less than 1 to 14. Preferably, the pre-plating compositions are acidic with a pH of less than 7, more preferably less than 1 to 4.

The steel substrate is electrolytically polarized in the pre-plating composition. Electrolytically polarizing the steel micro-etches the steel surface to remove carbon residues, oils, $Fe(OH)_2$, oxides and other steel substrate inclusions, such as sulfur compounds and silicon. Electrolytic polarization also helps increase surface activity by removing metal oxides and hydroxide species to promote the homogeneity of the steel and maintains a low iron content in the electroplating baths by removing $Fe(OH)_2$ from the steel surface. Current density may range from 0.1-100 A/dm$^2$, preferably from 1 A/dm$^2$ to 50 A/dm$^2$, more preferably from 1 A/dm$^2$ to 20 A/dm$^2$.

The cell which includes the pre-plating composition and where the steel substrate is electrolytically polarized is divided into two chambers by an insulator. Each chamber includes an electrode composed of inert material. Such inert electrodes are conventional and well known in the art. Examples of such inert electrodes are indium oxide coated titanium and platinum coated titanium. The steel substrate is passed into the first chamber of the cell where the substrate is anodic. The anodic polarization generates hydrogen gas at the electrode and oxygen gas or ionized metallic species at the steel surface or mixtures of oxygen gas and ionized metallic species. The substrate then passes into the second chamber of the cell where the substrate is cathodic. Cathodic polarization generates hydrogen gas on the substrate and oxygen gas at the electrode surface. The electrolytic polarization activates the surface and provides a homogeneous surface to receive tinplate. The temperature of the pre-plating composition may range from 20-100° C., preferably from 30-50° C. It may be beneficial to operate in a reverse current situation where the steel is polarized in the inverse order either permanently for certain grades of steel such as double-reduced or having higher than average surface soils or temporarily to clean the electrodes.

After the surface of the steel substrate has been activated, had surface dirt removed and been enriched with the pre-plate components, it is passed to at least one tin or tin alloy electroplating bath. Preferably the steel substrate is passed through a plurality of tin or tin alloy electroplating baths. The initial electroplating bath plates a layer of tin or tin alloy, typically from 20 nm to 40 nm thick, on the activated and homogeneous steel substrate and the steel plated with the tin or tin alloy strike layer may then be passed to one or more additional tin or tin alloy electroplating baths where tin or tin alloy is electroplated on tin or tin alloy to increase the thickness of the deposited layer. Tin or tin alloy is electroplated until the steel has a tin or tin alloy coating of 0.05 g/m$^2$ to 11.2 g/m$^2$, preferably from 0.4 g/m$^2$ to 5.6 g/m$^2$, more preferably from 0.5 g/m$^2$ to 2.8 g/m$^2$. The porosity of the tin or tin alloy layer is substantially lower than the porosity of a tin or tin alloy layer electroplated on steel without the application of the pre-plating composition in combination with the electrolytic polarization. The porosity of the tinplate or tin alloy plate may be low enough such as to allow for the substitution of higher coating weight tinplate with lower coating weight tinplate without compromising the desired lifetime of the product.

While conventional tin and tin alloy electroplating baths may be used to deposit the tinplate or tin alloy plate the components of the bath may be reduced by 10 wt % or more, preferably from 10 wt % to 50 wt %, more preferably from 10 wt % to 30 wt % in view of the application of the pre-plate treatment. Such tin and tin alloy baths are well known in the art and many are commercially available or are described in the literature. RONASTAN™ Tin Electroplating Solutions are examples of commercially available tin electroplating baths (available from Dow Electronic Materials, Marlborough, Mass.). Tin alloys which may be electroplated on steel or other iron containing substrates include, but are not limited to, tin/nickel, tin/zinc, tin/copper, tin/bismuth, tin/cobalt and tin/indium. Examples of ternary alloys which may be used are tin/copper/zinc and tin/nickel/copper.

Plating methods include, but are not limited to, barrel plating, rack plating and reel-to-reel high speed plating. Conventional current density may be used to plate the tin or tin-alloy. In general, the current densities range from 0.1 A/dm$^2$ to 200 A/dm$^2$.

After plating is completed the tin or tin alloy coated substrate is rinsed with water and optionally is rinsed in a cell in a dilute fluxing agent to inhibit formation of tin oxides and tin hydroxides. Conventional fluxing agents and methods may be used.

After rinsing with the dilute fluxing agent, the tin or tin-alloy deposit is typically reflowed by conduction heating, induction heating or combinations thereof. Tin and tin-alloys may be reflowed at temperatures of 235° C. to 300° C. Such reflow methods and conduction and induction heaters are well known in the art. After the tin or tin-alloy has been reflowed, the substrate with the deposit can be further processed using conventional methods.

The methods provide a more homogeneous substrate surface which is substantially free of carbon residues, oils, $Fe(OH)_2$, oxides and other steel substrate inclusions, such as low sulfur and silicon which cannot be plated over. The pre-plating composition coats the steel surface prior to tin plating and ensures a high surface-additive concentration which is less dependent on the additive concentrations in the tin plating bath. The methods also provide finer as plated tin grain size and reduced overall porosity and a denser $FeSn_2$ intermetallic layer, thus inhibiting oxygen penetration of the tin and $FeSn_2$ intermetallic layers and reducing corrosion of the underlying steel substrate. The $FeSn_2$ intermetallic layer's thickness is controlled by time and temperature during the reflow process: having a high nucleation density during the initial plating strike leads to a denser than conventional $FeSn_2$ intermetallic layers, thus less tin is consumed by the intermetallic layer and more free tin is provided, thus the life of the steel substrate is increased.

The following examples are intended to further illustrate the invention but not to limit the scope of the invention.

EXAMPLES 1-5

Analytical Method for Determining Porosity of Light Tinplate Coatings

Theory: Potassium ferrocyanide etches both tin and steel. If the ferrous substrate is exposed to potassium ferrocynide through either porosity or general etching a stable blue-colored complex (potassium ferri-ferro cyanide, or Prussian blue) is formed. A filter-paper disk soaked in potassium ferrocyanide solution is used to apply the etching solution and capture the colored compound formed for quantification by computer-software image analysis by Pax-it™.

Equipment
- 50 g/l potassium ferrocyanide solution in DI water
- Watman filter paper disks (10 cm, 5 micron)
- 1 kg weight, 5 cm diameter, flat bottom
- Image analysis software provided by Pax-it™

Method
- Place filter paper disks in ferrocyanide solution and allow excess to drip-off.
- Place wet paper disk on top of clean and dry tinplate coupon.
- A 1 kg weight is placed on the filter-paper disk and removed after 2 minutes.
- The blue-spotted filter paper is then removed and allowed to dry on the benchtop.
- Image analysis is performed to quantify the percent area that was blue (3 cm$^2$ sample area), and the results are reported as a percentage of blue color against the white paper background.

Production of Thin Tin Tinplate

Five steel coupons 5 cm×15 cm are wrapped around separate stainless steel mandrels. The Standard cleaning and oxide-removal that is performed for each is:
- 10 seconds exposure to a 50° C., 50 g/L NaOH solution while passing 10 A/dm$^2$ cathodic (hydrogen evolution)
- Water rinse for 10 seconds, mild hand agitation
- 10 seconds exposure to a 50 g/L sulfuric acid solution at ambient temperature, mild hand agitation
- Water rinse for 10 seconds, mild hand agitation The mandrels are then exposed to one or the five Pre-Treatments (detailed below) and placed into a tin plating solution comprising the following:
- 20 g/l stannous tin
- 40 g/l methane sulfonic acid
- 50 ml/l RONASTAN™ TP-G7 MAKEUP solution (available from Dow Electronic Materials)

Each mandrel is rotated at 1500 RPM and a current of 30 A/dm$^2$ (cathodic) is passed for varying amounts of time (from 0.5 to 3 seconds) to achieve specific target thickness. After plating the steel coupons are removed, rinsed and straightened by hand, placed in a solution containing 1% RONSTAN™ TP-FLUX CONCENTRATE solution, air-dried and heated by passing 100 A for 5-seconds to allow the tin to melt completely, followed by water-quenching.

The tin coating thickness is confirmed by XRF measurement by and reported in g/m$^2$; the porosity is measured using the method described above and the results reported in %. The data of percentage porosity against tin coating thickness is plotted for the various pre-treatment conditions and compared to the standard method, namely no Pre-Treatment (apart from cleaning and oxide removal as detailed above).

Pre-Treatment Conditions Tested

1. No pretreatment—the control

Anodic polarization at 5 ASD for 1 second followed by cathodic polarization at 5 ASD for one minute using IrOx-coated Ti insoluble anodes in an aqueous solution of
- a. 3 g/l methane sulfonic acid 2. Anodic polarization at 5 ASD for 1 second followed by cathodic polarization at 5 ASD for one second using IrOx-coated Ti insoluble anodes in an aqueous solution of
- a. 1 g/l methane sulfonic acid
- b. 5 g/L 3,5-dihydroxybenzene sulfonic acid
- c. 2 g/l polyethylene glycol, average molecular weight of 16,000 g/mol 3. Anodic polarization at 5 ASD for is followed by cathodic polarization at 5 ASD using IrOx-coated Ti insoluble anodes in an aqueous solution of a. 1 g/L methane sulfonic acid
b. 1 g/L sulfuric acid
c. 1 g/L 5-sulfosalicylic acid
d. 2 g/L poly(ethylene oxide)-poly(propylene oxide)-poly (ethylene oxide) triblock copolymer with a molecular weight range of 1800 to 2700 g/mol 4. Anodic polarization at 5 ASD for 1 second followed by cathodic polarization at 5 ASD for 1 second using IrOx-coated Ti insoluble anodes in an aqueous solution of a. 1 g/L methane sulfonic acid
b. 2 g/L sulfuric acid
c. 2 g/L of an alkoxylated linear alcohol with an average molecular weight range from 600 to 900 g/mol
d. 2 g/l polyethylene glycol, average molecular weight of 16,000 g/mol The data for the five coupons produced using the pre-treatments above are expected to be as in the Table. The Figure is a plot of the data from the Table. The porosity of the steel treated with the pre-plate formulations is expected to decrease in contrast to the control and the pre-treatment formulation which only included an aqueous solution of methane sulfonic acid.

| Sn ($g/m^2$) | Pre-treat 1 | Pre-treat 2 | Pre-treat 3 % Porosity | Pre-treat 4 | Pre-treat 5 |
|---|---|---|---|---|---|
| 0.5 | 76 | 81 | 64 | 56 | 48 |
| 1 | 44 | 54.5 | 38 | 30 | 27 |
| 2 | 26 | 25 | 12 | 10 | 7.8 |
| 2.8 | 11.0 | 14 | 9.6 | 7.7 | 8.6 |
| 4.2 | 5.7 | 6.3 | 6.8 | 3.9 | 4.3 |
| 5.6 | 3.2 | 3.7 | 2.8 | 2.2 | 2.9 |

What is claimed is:

1. A method comprising:

a) providing a steel substrate;

b) contacting the steel substrate with a pre-plating composition comprising one or more organic sulfonic acids, salts or anhydrides thereof and one or more grain refiners, wherein the pre-plating composition does not include metal or metal ions;

c) electrolytically polarizing the steel substrate in contact with the pre-plating composition by anodic polarization followed by cathodic polarization to activate a surface of the steel substrate; and d) electrolytically plating a tin or a tin alloy layer on the activated surface of the steel substrate with a tin or a tin alloy electroplating bath.

2. The method of claim 1, wherein the tin or tin alloy layer comprises a $FeSn_2$ intermetallic layer of 0.1-1.4 $g/m^2$.

3. The method of claim 1, wherein the one or more grain refiners are chosen from carboxy aromatic compounds, alkoxylates, alkylene oxide compounds and polyalkylene glycols.

4. The method of claim 3, wherein the one or more grain refiners are in amounts of 0.01 g/L to 20 g/L.

5. The method of claim 1, wherein the pre-plating composition further comprises one or more metal solubilizing agents.

6. The method of claim 1, wherein the pre-plating composition further comprises one or more inorganic acids.

7. The method of claim 1, wherein the one or more organic sulfonic acids, salts or anhydrides thereof are in amounts of 0.1 g/L to 50 g/L.

8. The method of claim 1, wherein the pre-plating composition further comprises one or more tin plating promoting agents.

9. The method of claim 8, wherein the one or more tin plating promoting agents are chosen from reducing agents and brightening agents.

10. The method of claim 1, wherein the pre-plating composition further comprises one or more buffering agents.

* * * * *